US006355209B1

(12) United States Patent
Dilmore et al.

(10) Patent No.: US 6,355,209 B1
(45) Date of Patent: Mar. 12, 2002

(54) METAL CONSOLIDATION PROCESS APPLICABLE TO FUNCTIONALLY GRADIENT MATERIAL (FGM) COMPOSITONS OF TUNGSTEN, NICKEL, IRON, AND COBALT

(75) Inventors: Morris F. Dilmore, Baker, FL (US); Henry S. Meeks, III, Roseville; Marc S. Fleming, Rancho Cordova, both of CA (US)

(73) Assignee: Ceracon, Inc., Carmichael, CA (US)

( * ) Notice: Subject to any disclaimer, the term of this patent is extended or adjusted under 35 U.S.C. 154(b) by 0 days.

(21) Appl. No.: 09/551,248

(22) Filed: Apr. 18, 2000

Related U.S. Application Data

(60) Provisional application No. 60/165,781, filed on Nov. 16, 1999.

(51) Int. Cl.[7] ..... B22F 3/12
(52) U.S. Cl. ..... 419/38; 419/44; 419/49
(58) Field of Search ..... 419/38, 44, 49

(56) References Cited

U.S. PATENT DOCUMENTS

| | | | |
|---|---|---|---|
| 4,140,711 A | 2/1979 | Convers | 260/513 B |
| 4,539,175 A | 9/1985 | Lichti et al. | 419/49 |
| 4,933,140 A | 6/1990 | Oslin | 419/23 |

*Primary Examiner*—Ngoclan Mai
(74) *Attorney, Agent, or Firm*—William W. Haefliger

(57) ABSTRACT

A method of consolidating metal powder to form an object that includes pressing the powder into a preform, and preheating the preform to elevated temperature; providing flowable pressure transmitting particles and transmitting microwaves into the particles to heat same, and providing a bed of the flowable and heated pressure transmitting particles; positioning the preform in such relation to the bed that the particles substantially encompass the perform; and pressurizing the bed to compress the particles and cause pressure transmission to the preform, thereby to consolidate the preform into a desired object shape, the powder of step a) consisting essentially of at least two of the following: W, Ni, Fe, Co, manganese and titanium, and preferably at least three of same.

30 Claims, 12 Drawing Sheets

12X MAGNIFICATION
MONOLITHIC W-Ni-Fe-Co (TOP)
80W/20Fe FGM COMPOSITION INTERFACE

SEM CLEARLY SHOWS .012" EDM WIRE CUT

SEE FIG. 10a.

600X MAGNIFICATION
MONOLITHIC W-Ni-Fe-Co

NOTE: WHMA GRAINS TOO SMALL TO BE SEEN AT 600X (NEED AT LEAST 2000X)

80X MAGNIFICATION
MONOLITHIC W-Ni-Fe-Co (TOP)
80W/20Fe FGM COMPOSITION INTERFACE

NOTE: WHMA TOO SMALL TO SEE AT 80X

80X MAGNIFICATION

FGM COMPOSITION INTERFACE

80W/20Fe (TOP)

60W/40Fe (BOT)

80X MAGNIFICATION
FGM COMPOSITION INTERFACE
60W/40Fe (TOP)
40W/60Fe (BOT)

80X MAGNIFICATION
FGM COMPOSITION INTERFACE

40W/60Fe (TOP)
20W/80Fe (BOT)

80 X MAGNIFICATION
FGM COMPOSITION INTERFACE
20W/80 Fe (TOP)
MONOLITHIC STEEL (BOT)

METAL CONSOLIDATION PROCESS APPLICABLE TO FUNCTIONALLY GRADIENT MATERIAL (FGM) COMPOSITONS OF TUNGSTEN, NICKEL, IRON, AND COBALT

This application claims priority from provisional application Ser. No. 60/165,781, filed Nov. 16, 1999.

BACKGROUND OF THE INVENTION

This invention relates generally to the field of consolidating hard metallic bodies, and also to rapid and efficient and heating and handling of granular media employed in such consolidation, as well as rapid and efficient heating and handling of pre-form powdered metal or metal bodies to be consolidated, where such bodies consist essentially of tungsten, nickel and iron, and/or cobalt.

The technique of employing carbonaceous particulate or grain at high temperature as pressure transmitting media for-producing high density metallic objects is discussed at length in U.S. Pat. Nos. 4,140,711, 4,933,140 and 4,539,175, the disclosures of which are incorporated herein, by reference.

The present invention provides improvements in such techniques, and particularly improvements in such techniques, and particularly improvements leading to consolidation of bodies consisting of tungsten, nickel and iron, and/or cobalt, and functionally gradient material (FGM) compositions thereof. Such bodies may contain minor amounts of cobalt, manganese, and/or titanium, as minor compositional elements.

SUMMARY OF THE INVENTION

It is a major object of the invention to provide for consolidation of metallic powder consisting of tungsten, nickel and iron, as may be employed in target penetration, drilling, and related impact activities. Such powder may contain minor amounts of cobalt, manganese, and/or titanium, as minor compositional elements.

It is another object of the invention to provide rapid and efficient heating of carbonaceous and/or ceramic particles used as pressure transmitting media, and also transfer of heat generated in the particles to the work, i.e. the hard metal pre-form to be consolidated. Basic steps of the method of consolidating the preform metallic body in any of initially powdered, sintered, fibrous, sponge, or other form capable of compaction, or densification (to reduce porosity) then include the steps:

a) providing flowable particles having carbonaceous and ceramic composition or compositions, b) heating the particles to elevated temperature, c) locating the heated particles in a bed, d) positioning the preform body at the bed, to receive pressure transmission, e) effecting pressurization of said bed to cause pressure transmission via said particles to the body, thereby to compact the body into desired shape, as for example cylindrical shape, increasing its density; and f) the body to be consolidated consisting essentially of the metals tungsten, nickel and iron. The body may optimally contain minor amounts of cobalt, manganese, and/or titanium, as minor compositional elements.

Another object is to achieve rapid or almost instantaneous densification of composite metal alloy system, the resultant material being fine grained, isotropic, and maintaining original metastable microstructures. In the case of tungsten powder, coated with nickel and iron, or with other metals or ceramics, densification occurs so rapidly and at such a low temperature, that tungsten-tungsten contiguity is virtually non-existent.

A further object is to produce a functionally gradient material (FGM) for use as a shaped, heavy metal penetrator, a particular FGM material powder system used being comprised of a tungsten-nickel-iron-cobalt heavy metal powdered alloy (WHMA) nose section, such as a tungsten composite, high strength steel and tungsten coated powder and transitioning to a high strength steel based powder. It may include an intermediate layer of metal matrix composite of the WHMA, and low alloy steel powder (LAS), and a monolithic LAS base section. The powdered material system employs tungsten particles coated with prealloyed binder composition but other elementally blend, mixed or otherwise combined particles are applicable. The total binder typically consists of elemental nickel (Ni) and iron (Fe) and cobalt (Co) of approximately 16 weight percent of the total composition; but other compositions may be employed.

The ability to fabricate a functionally gradient heavy metal penetrator in one single forging operation has several advantages. The first is the ability to design and engineer a penetrator with specific and predictable dynamic performance criteria. The second advantage is that of reduced manufacturing costs directly related to fewer hot forging steps. Additional cost reductions are realized in the area of raw material usage by eliminating forging trim and scrappage resulting from the use of a powder metallurgy, near net shape forging preform.

By the use of the methodology of the present invention, substantially improved structural articles of manufacture can be made having minimal distortion, as particularly enabled by the use of carbonaceous, or ceramic, or carbonaceous/ceramic particulate in flowable form.

An additional object includes provision of a method for consolidating hard metal and/or ceramic powder, and/or composite material with or without polymeric powder, to form an object, that includes a) pressing the FGM into a preform, and preheating the preform to elevated temperature, b) providing flowable pressure transmitting particles and heating said particles, and providing a bed of said flowable and heated pressure transmitting particles, c) positioning the FGM preform in such relation to the bed that the particles substantially encompass the preform, d) and pressurizing the bed to compress said particles and cause pressure transmission via the particles to the preform, thereby to consolidate the preform into a desired object shape, having final density.

The preform typically consists of a tungsten, nickel iron complex, which may contain minor amounts of Co, Mn and/or Ti.

An additional object is to provide a body to be consolidated having varying metallic composition along a body dimension. That varying composition may be characterized by a series of zones, extending either axially or radially for example along the article's axis each zone having a characteristic composition which differs from that of an adjacent zone or zones. The metal in successive zones may consist of at least two of the metals tungsten, nickel, iron, and cobalt, and may consist of all three of tungsten, nickel, and iron, or all four, but in varying proportions in successive zones. For a projectile having great penetration capability, a tapered nose zone may consist primarily of tungsten, and successive zones to the rear may contain less and less tungsten, WHMA and more and more steel.

For a three metal body, the metals being $M_1$, $M_2$ and $M_3$, the weights $W_1$, $W_2$ and $W_3$ per unit volume of the respective metals $M_1$, $M_2$ and $M_3$ are related and selected, to be as follows:

$W_1>W_2>W_3$

The novel features which are believed to be characteristic of this invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purposes of illustration and description only and are not intended as a definition of the limits of the invention.

DRAWING DESCRIPTION

Figure 8B:
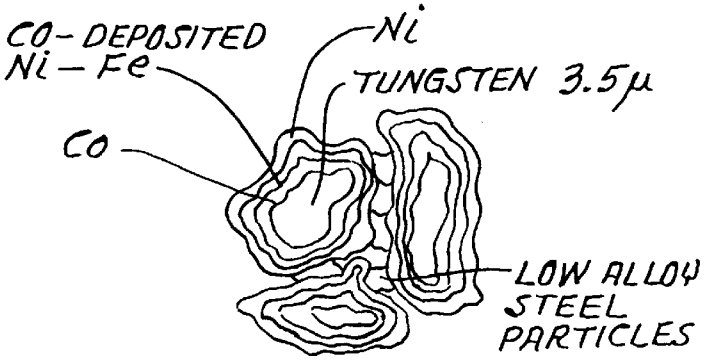
Figure 8A:
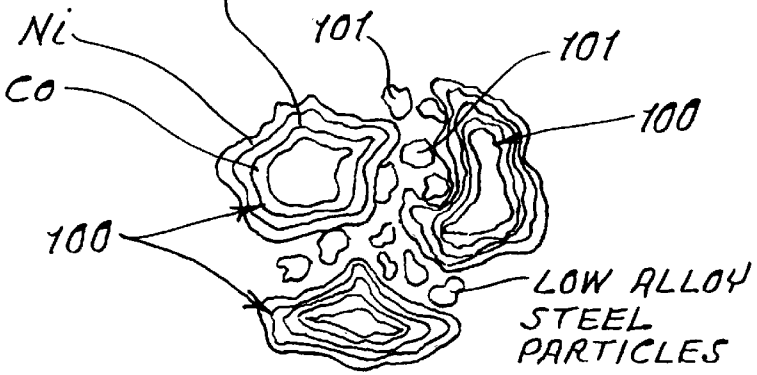
Figure 9:
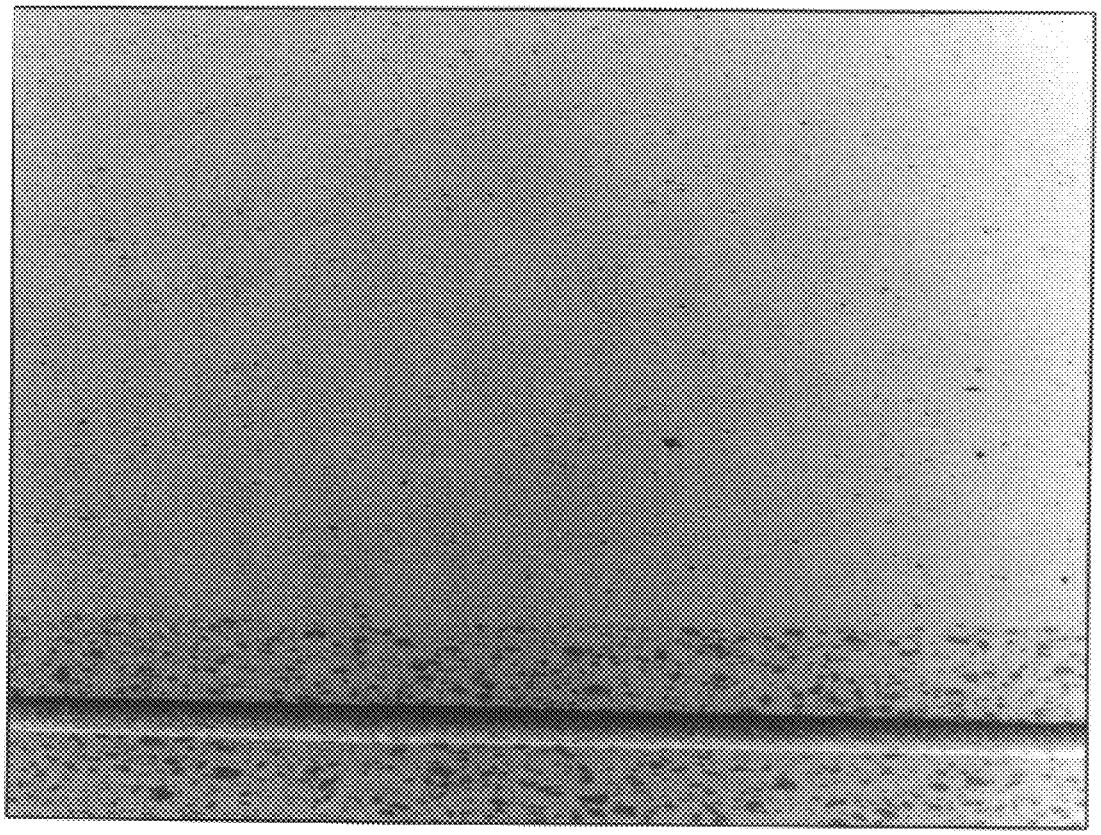
Figure 10:
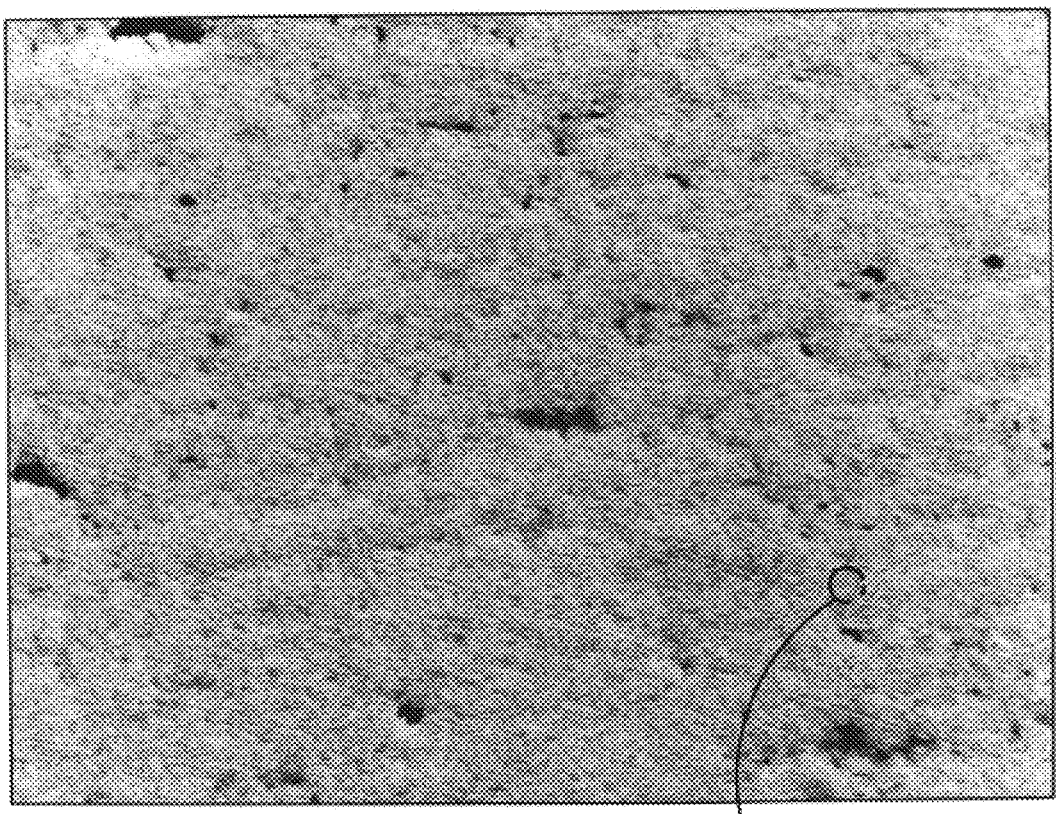
Figure 10A:
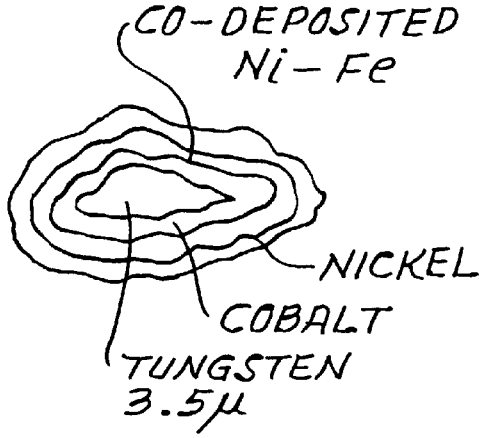
Figure 11A:
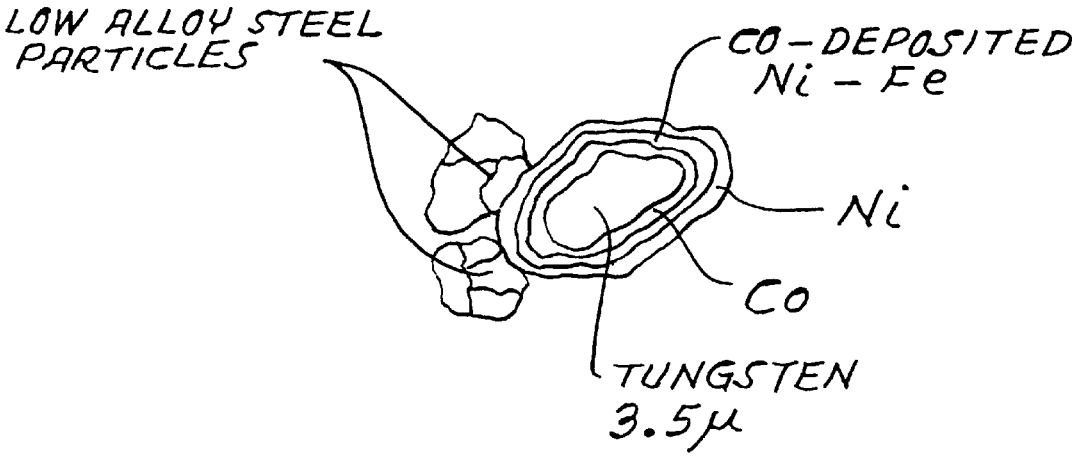
Figure 11:
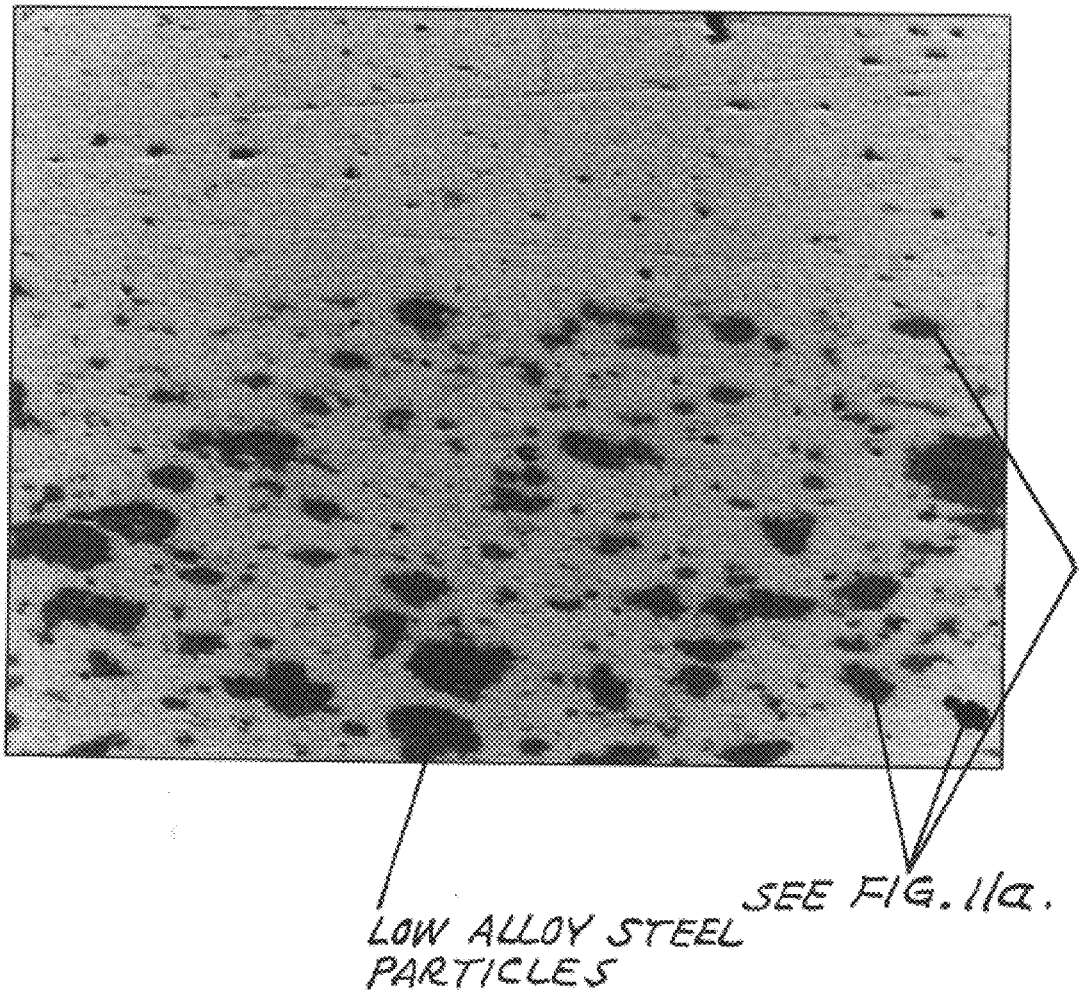
Figure 12:
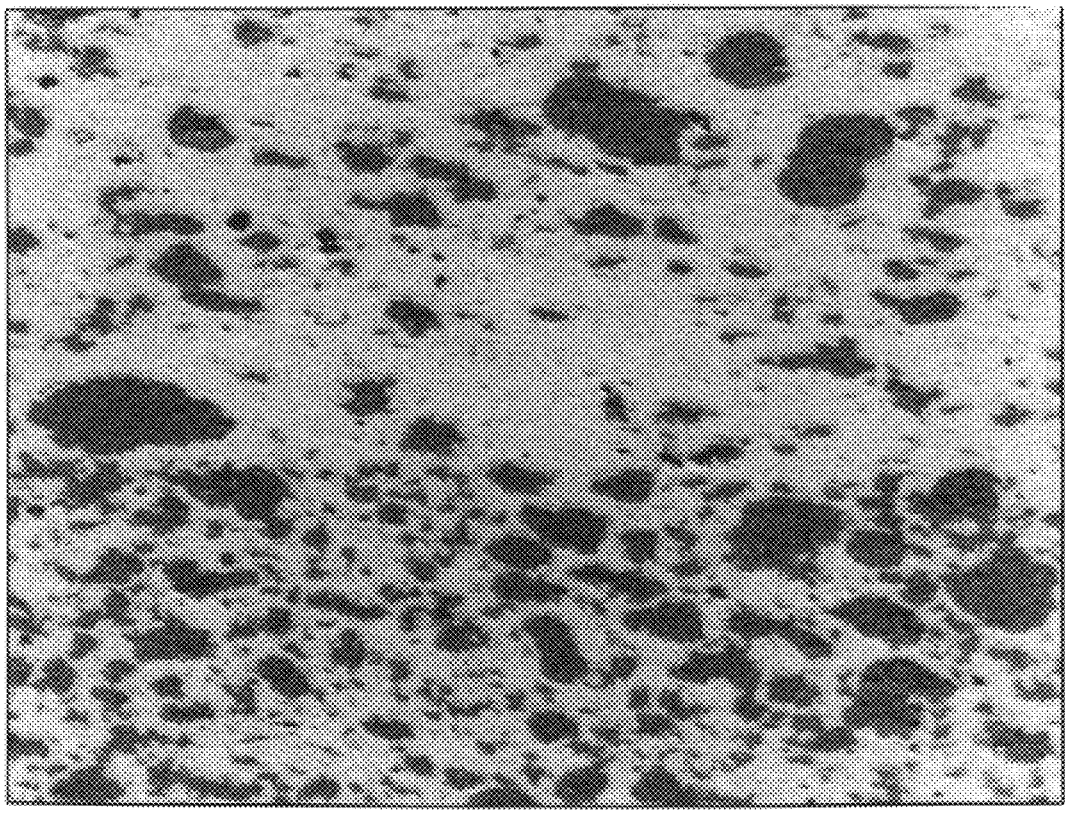
Figure 13:
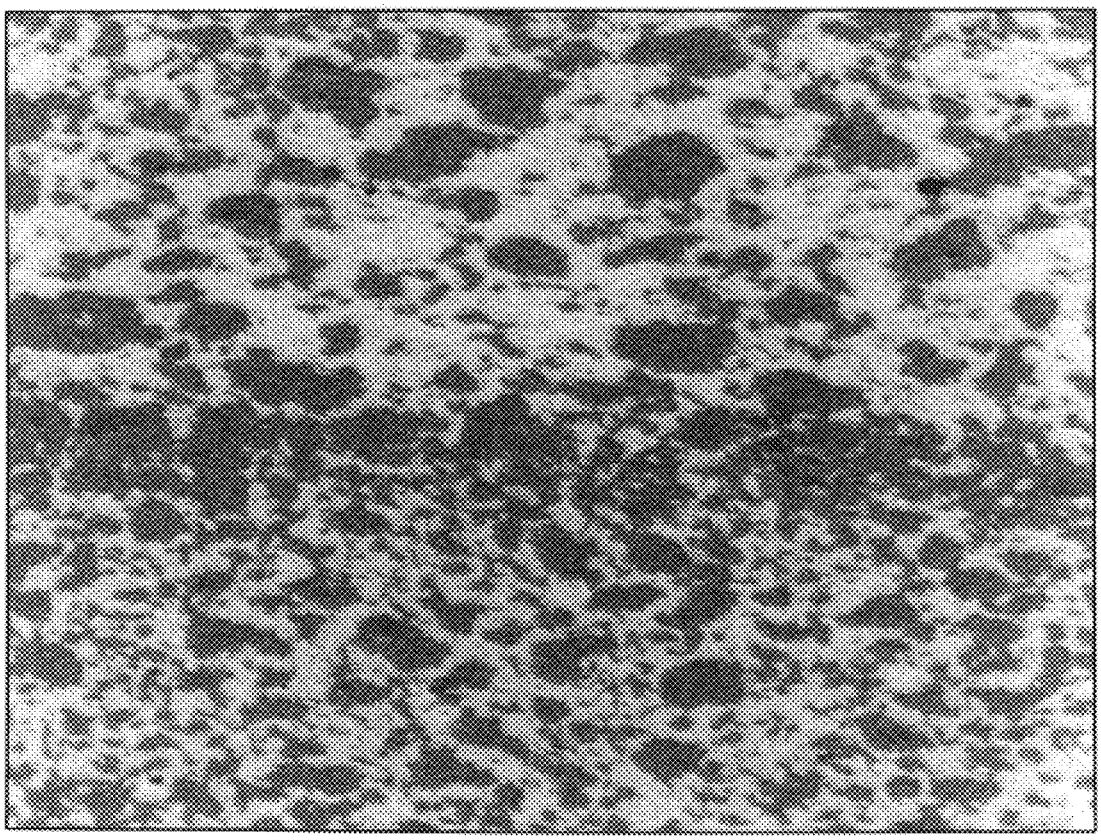
Figure 14:
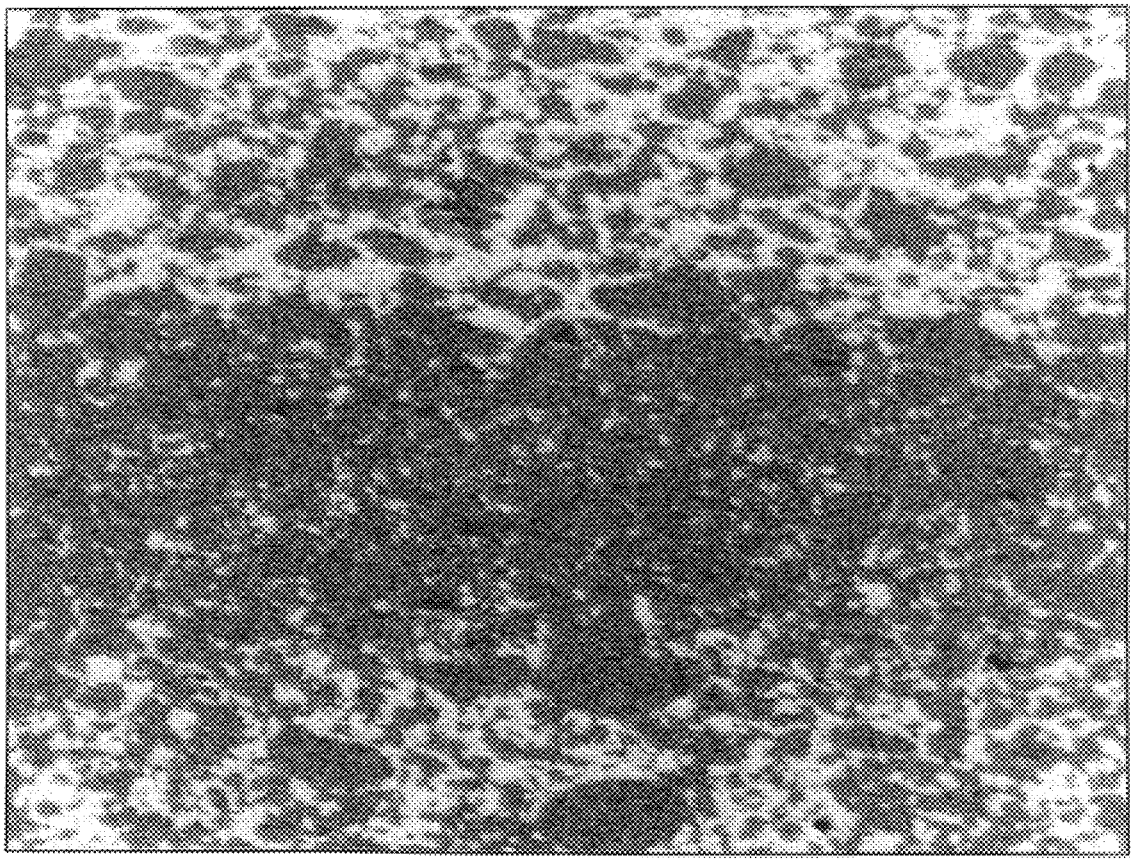
Figure 15:
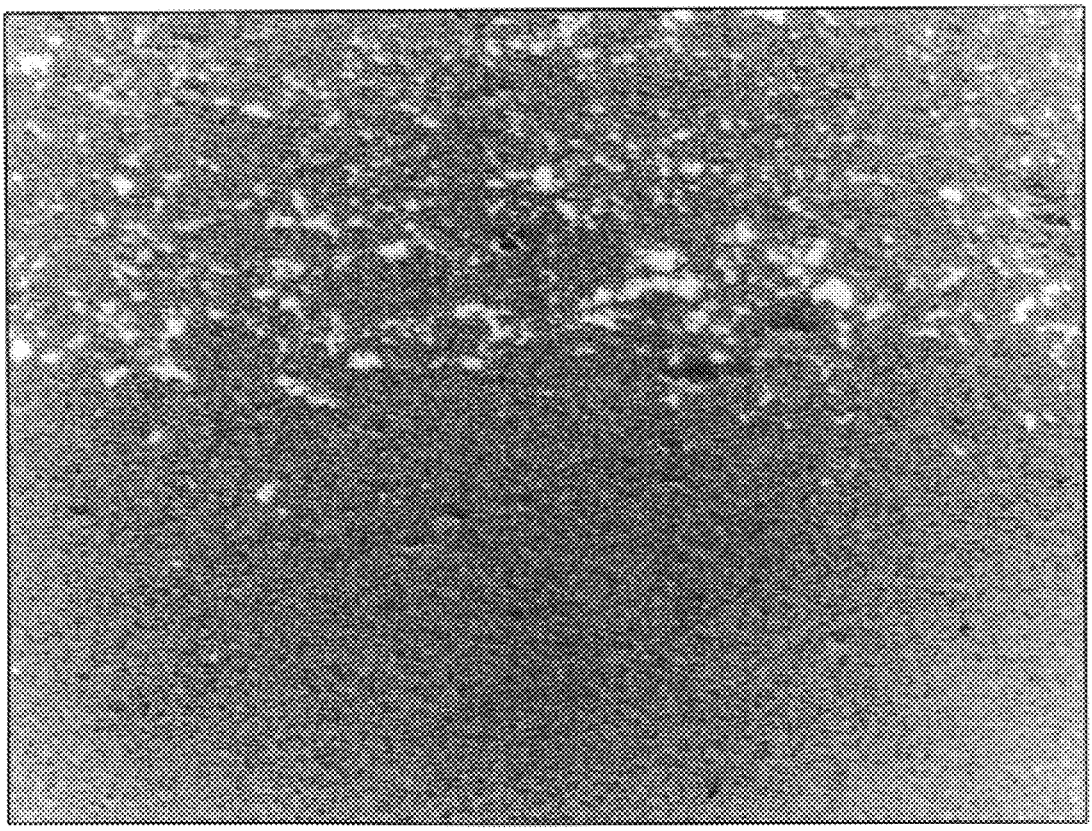

FIGS. 8*a* and 8*b* are enlarged views showing the coated tungsten particles and low alloy steel particles in the preform, prior to and after consolidation;

FIGS. 9–15 show magnified microstructure of different, consolidated powdered metal compositions, as indicated;

FIG. 10*a* shows a tungsten particle with layers of Co, Ni—Fe, and Ni, as found in FIG. 10 matrix; and FIG. 11*a* shows a tungsten particle with deposited layers of Co, Ni—Fe, and Ni, surrounded by low alloy steel particles as found in FIG. 11 matrix.

DETAILED DESCRIPTION

Figure 1:
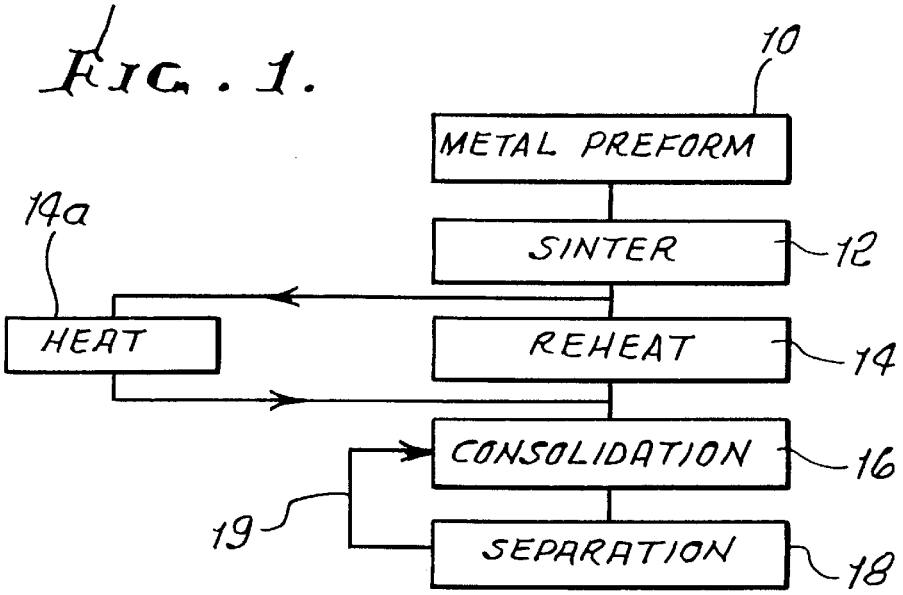
FIG. 1 is a flow diagram showing method steps of the present invention.
Figure 3:
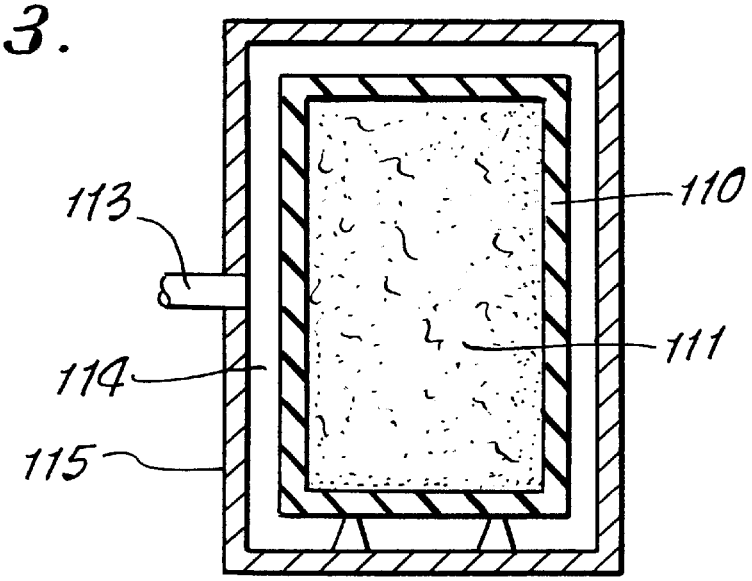
FIG. 3 is a vertical section showing pre-form pressurization, prior to consolidation.
Figure 5:
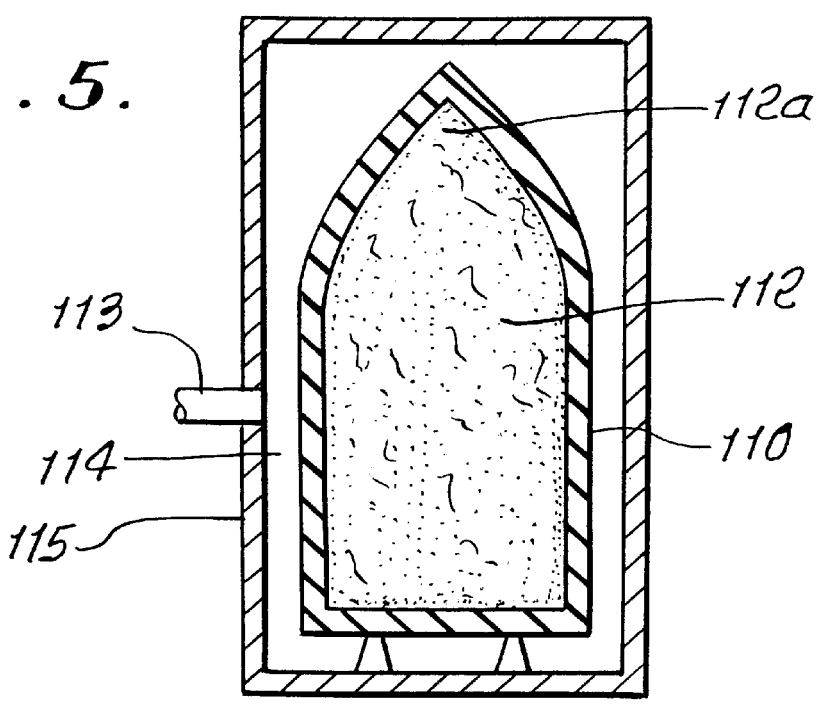
FIG. 5 is a view like FIG. 3 showing a different shaped preform.

Referring first to FIG. 1, there is shown a flow diagram illustrating method steps of the present invention. As can be seen from numeral 10, initially a metal, metal and ceramic, or ceramic article of manufacture or pre-form is made, for example, in the shape of a penetrator or other body or impact tool such as a drill or other product. The preferred embodiment contemplates the use of a metal pre-form made of a powdered tungsten, partially coated with nickel, iron, and cobalt then mechanically blended with a low alloy steel powder. Minor amounts of manganese and/or titanium may be included. Other metallic or ceramic particles or coatings may also be included. See for example FIG. 8(*a*) showing tungsten particles 100 coated with or surrounded by nickel, iron, and cobalt alloy 101, in a preform; the smaller particles 101 may also represent separate nickel, iron and cobalt particles, as well as the low alloy steel particles, or combinations of such metals. A pre-form typically is about 60 to 85 percent of theoretical density-after the powder has been made into a pre-formed shape, and it may typically subsequently be sintered (see step 12 in FIG. 1) in order to increase the strength. In the preferred embodiment, the pre-form in billet form is subjected to cold or ambient temperature isostatic compaction at about 60,000 pounds per square inch, preferably within an evacuated and sealed elastomeric (rubber) container. See for example FIG. 3 showing evacuated, sealed elastomeric container 110, with the preform 111 located therein, and shaped in the form of a cylinder. FIG. 5 is like FIG. 3, but shows the preform 112 shaped in the form of a cylinder and having a tapered end 112*a*, for penetration of hard targets. Fluid pressure is supplied at 113 to the interior 114 of a metal vessel 115 within which the tungsten, nickel, iron powdered metal preform, and its elastomeric container are located, to pressurize the container and compact the powder preform. Once the billet preform has been compacted to about 60% of theoretical density, it is heated in a protective or reducing atmosphere, such as Argon or hydrogen, to above 900° C., in preparation for consolidation. See step 14*a* in FIG. 1. Alternative steps include step 12 sintering in FIG. 1, and re-heating at 14.

The consolidation process, illustrated at 16 in FIG. 1, takes place after the hot pre-form (removed from 110 and 115) has been placed, as for example in a bed of heated carbonaceous or carbonaceous/ceramic particles as hereinbelow discussed in greater detail. Consolidation takes place by subjecting the embedded pre-form to elevated temperature and high pressure. In a preferred embodiment, temperatures in the range of about 1,600° F. and uniaxial pressures of about 5 to 100 and higher TSI are used, for compaction. The pre-form has now been densified and can be separated, as noted at 18 in FIG. 1, whereby the carbonaceous particles separate readily from the pre-form and can be recycled as indicated at 19. If necessary, any particles adhering to the pre-form can be removed and the final product can be further finished, as for example machined.

Final product dimensional stability, to a high and desirable degree, is obtained when the particle (grain) bed primarily (and preferably substantially completely) consists of flowable carbonaceous and/or ceramic particles. For best results, such carbonaceous particles are resiliently compressible graphite beads, and they have outward projecting nodules on and spaced part on their generally spheroidally shaped outer surfaces, as well as surface fissures. See for example U.S. Pat. No. 4,640,711. Their preferred size is between 50 and 240 mesh. Useful granules are further identified as desulphurized petroleum coke. Such carbon or graphite particles have the following additional advantages in the process:

1. They form easily around corners and edges, to distribute applied pressure essentially uniformly to and over the body being compacted. The particles suffer very minimal fracture, under compaction pressure.
2. The particles are not abrasive, therefore reduced scoring and wear of the die is achieved.
3. They are elastically deformable, i.e. resiliently compressible under pressure and at elevated temperature, the particles being stable and usable up to 4,000° F.; it is found that the granules, accordingly, tend to separate easily from (i.e. do not adhere to) the body surface when the body is removed from the bed following compaction.
4. The granules do not agglomerate, i.e. cling to one another, as a result of the body compaction process. Accordingly, the particles are readily recycled, for reuse, as at 19 in FIG. 1.
5. The graphite particles become rapidly heated in response to passage of electrical current or microwaves therethrough. The particles are stable and usable at elevated temperatures up to 4,000° F. Even though graphite oxidizes in air at temperatures over 800° F. Short exposures as during heatup and cooldown, do not substantially harm the graphite particles.

Figure 2:
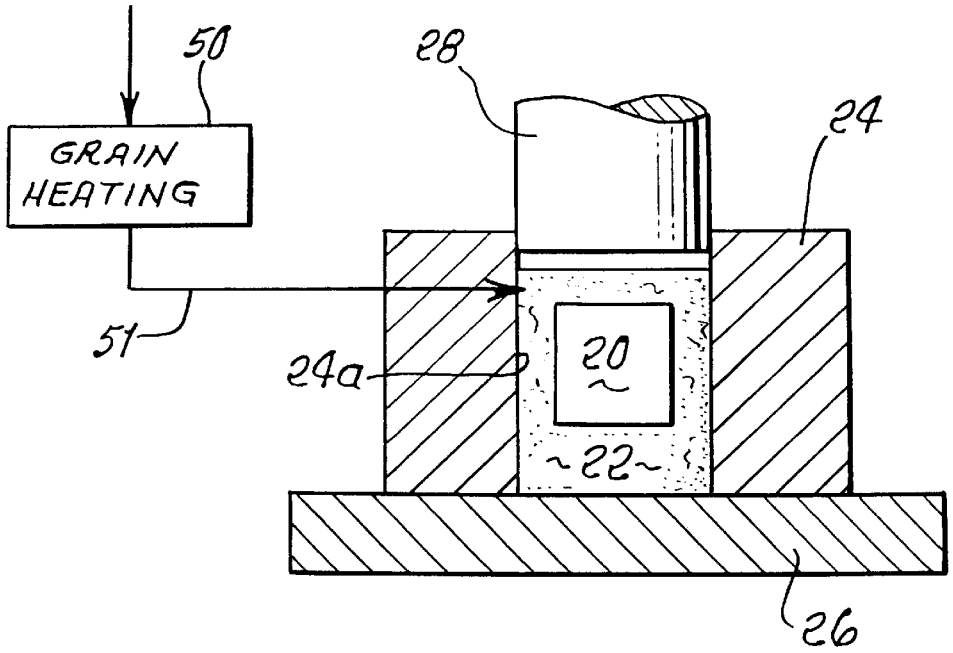
FIG. 2 is a cut-away elevation showing the consolidation step of the present invention.

Referring now to FIG. 2, the consolidation step is more completely illustrated. In the preferred embodiment, the pre-form 20 (as for example preform 111 or 112, or preform as at 111*a* or 112*a* in FIGS. 4 and 6) has been completely embedded in a bed of carbonaceous particles 22 as described, and which in turn have been placed in a contained zone 24*a* as in consolidation die 24. Press bed 26 forms a bottom platen, while hydraulic press ram 28 defines a top and is used to press down onto the particles 22 which distributes the applied pressure nonisostatically (30% deformation (compression) axially 10% deformation (tensile) radially) to the pre-form 20. The pre-form is at a temperature between 200° C. and 1,800° C., prior to compaction. The embedded metal powder pre-form 20 is rapidly compressed under high uniaxial pressure by the action of ram 28 in die 24, the grain having been heated to between 400° C. and 4,000° F. Pressurization is typically effected at levels greater than about 20,000 psi for a time interval of less than about 30 seconds. Particles may be located within a sub-bed in a deformable container, in bed 22.

Referring again to FIG. 2, a heating furnace 50 is shown, incorporating a fluidized bed of grain particles, to be supplied at 51 to die 24. Such PTM can be a carbonaceous and ceramic composite of varying composition ranging from 5 to 95 percent, by volume, of ceramic particles, the balance being carbonaceous particles. Usable ceramics include: aluminum oxide, boron carbide or nitride, and other hard ceramic materials. The heater may comprise an electrical resistance heater, or a microwave heater, for example.

Figure 4:
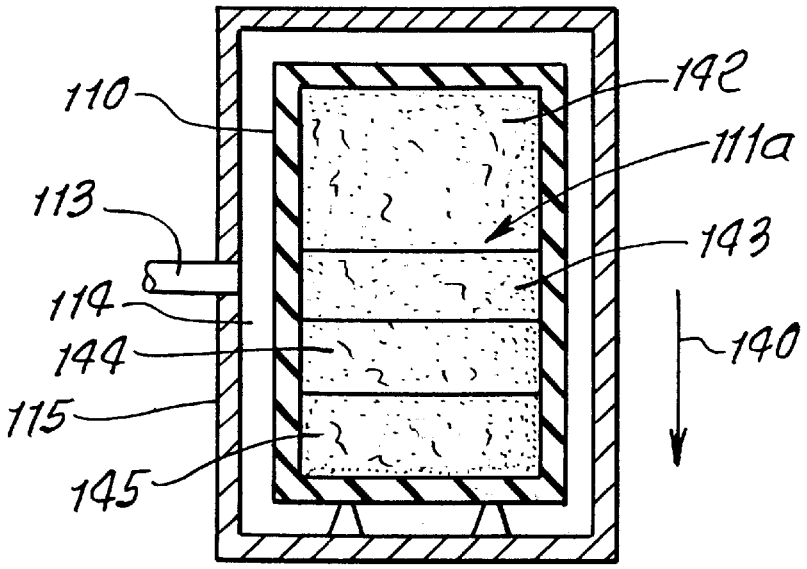
FIG. 4 is a view like FIG. 3, showing a modified preform.

FIG. 4 shows a preform 111*a*, similar to that at 111 in FIG. 3; however, the metal composition of the preform varies along its length direction, indicated by arrow 140. A stratified overall composition is indicated by multiple layers as for example at 142–145. Each layer may consist of one or more of powder form metals $M_1$ and $M_2$ (or mixture thereof), or metals $M_1$, $M_2$ and $M_3$ (or mixtures thereof), or metals $M_1$, $M_2$, $M_3$, $M_4$, $M_5$, and $M_6$ (or mixtures thereof). The selection of metals and mixtures, and their proportions as by weight, may be such as to produce an ultimate consolidated article wherein the hardness and toughness of the article (at zones corresponding to layers 142–145) varies, in the length direction 140; for example the hardness may decrease, progressively, in direction 140.

Figure 6:
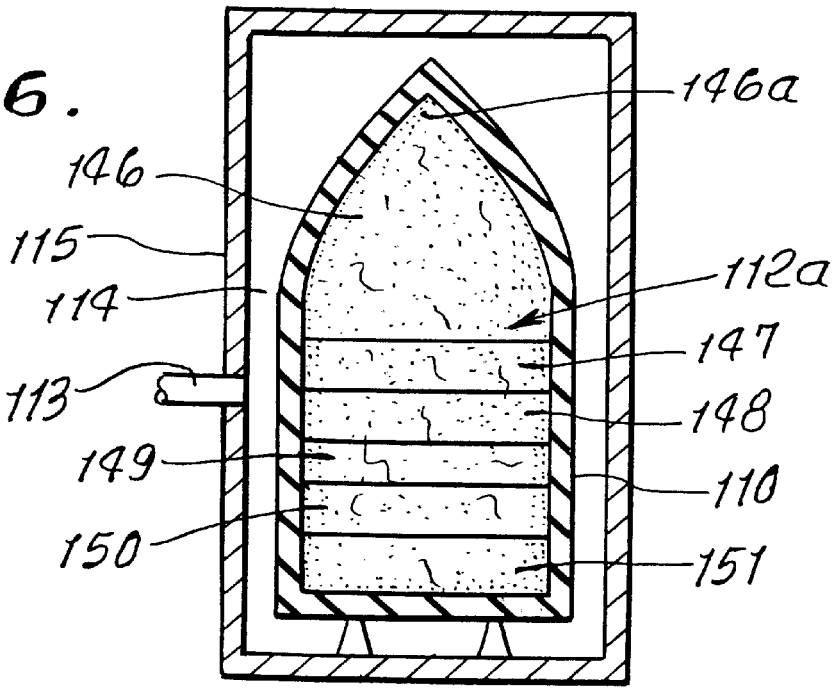
FIG. 6 is a view like FIG. 4, showing a different shaped preform.

In FIG. 6, the preform 112*a* corresponding to 112 of FIG. 5, also has a layered configuration indicated at layers 146–151, the top layer tapered toward nose 146*a*. Again, each layer may consist of one or more of powder from metals $M_1$ and $M_2$ (or mixture thereof), or metals $M_1$, $M_2$ and $M_3$ (or mixtures thereof) or metals $M_1$, $M_2$, $M_3$ and $M_4$ (or mixtures thereof), or metals $M_1$, $M_2$, $M_3$, $M_4$ and $M_5$ (or mixtures thereof), or $M_1$, $M_2$, $M_3$, $M_4$, $M_5$, and $M_6$ (or mixtures thereof). Again, the selection of metals may be such that ultimate hardness decreases and toughness increases, progressively and stepwise, in direction 140. Thus, for example, if the layer 146 consists of the very hard metal tungsten adapted for high velocity penetration of armor plate, or other hard target structures such as reinforced concrete and steel, underground bunkers such as those used to protect chemical and biological weapons of mass destruction (WMD). The opposite end layer 151 may consist primarily of iron or steel, adapted for employment or joining of the penetrator by welding or other means, to a body or body extension, such as a steel tube; or adapted for employment or handling in a gun barrel, or on a launching platform to compress somewhat during explosive firing of a gun or at or on the launching platform. Layer 151 is also adapted for welding or bonding to a steel penetrator tube with high strength or fracture toughness that will survive the penetration event.

Layer 146 may consist of particles of tungsten encapsulated within layers of cobalt, co-deposited Ni—Fe, and Ni, and defined as powder A. Layer 151 may consist of particles of low alloy steel, defined as powder B. Layers 147–150 may consist of mixtures of powder A and powder B, where the percentage by weight of powder A decreases in successive layers in direction 140, and the percentage by weight of powder B in successive layers increases in direction 140. The low alloy steel of powder B may consist primarily of Fe, and contain about 0.5% Cr, 1% Ni, 1% Mo and 0.25% C.

One example of the layer composition in FIG. 6 would be as follows:

Layer 146 consists primarily of powder A

Layer 147 consists of 80% powder A and 20% powder B

Layer 148 consists of 60% powder A and 40% powder B

Layer 149 consists of 40% powder A and 60% powder B

Layer 150 consists of 20% powder A and 80% powder B

Layer 151 consists of 100% powder B

A further definition of the composite is as follows: the body is elongated and has elongated and has a tapered nose portion, there being a second body portion along said dimension, the body consisting of at least two metals, $M_1$ and $M_2$, the proportions of $M_1$ and $M_2$ in said body nose portion and second body portion being different. For example, the metal $M_1$ is tungsten, the proportion of tungsten in said nose portion being greater than the proportion of tungsten in said second body portion. Further, the body has third and fourth body portions along said dimension, the proportion of tungsten in said second body portion exceeding the proportion of tungsten in said third body portion, and the proportion of tungsten in said third body portion exceeding the proportion of tungsten in said fourth body portion.

In addition, the body has first and second ends, the consolidated metal at the first end having higher density than the consolidated metal at the second end; and wherein the metal at the first end consists primarily of tungsten, and the metal at the second end consists primarily of steel.

Figure 7:
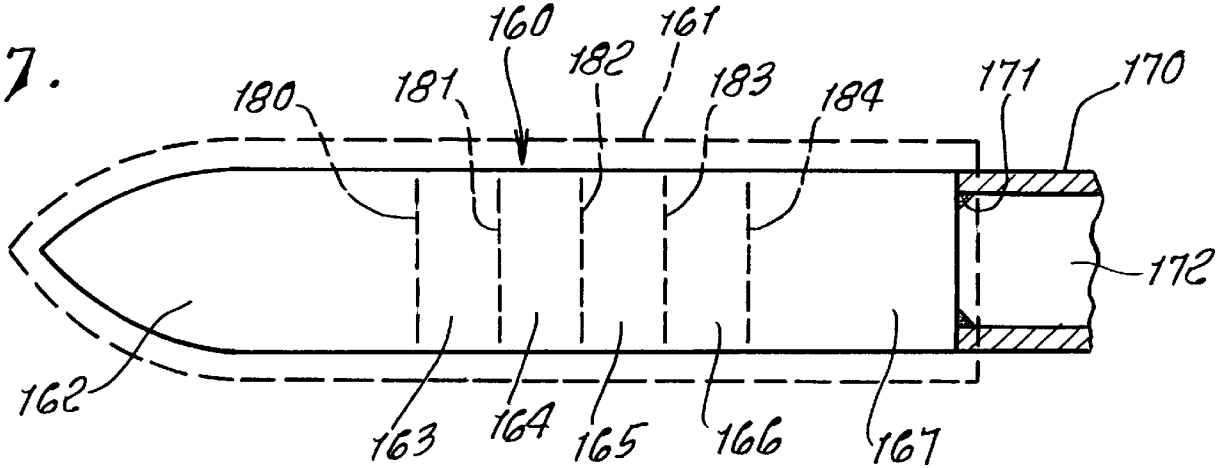
FIG. 7 is a view of a consolidated preform, similar to the pre-form of FIG. 6.

FIG. 7 shows by way of example a product 160 shaped generally like that of the preform 112*a*. The product 160 has been pressure consolidated, as described, to reduce its size from preform size indicated by the broken lines 161. Forward tapered portion 162 consists essentially of tungsten; the next layer portion 163 in sequence consists of 20% by weight low alloy (nickel) steel (LAS) and the balance tungsten; the next layered portion 164 in sequence consists of 40% LAS and the balance tungsten; the next layered portion 165 in sequence consists of 60% LAS and the balance tungsten; the next layered portion 166 in sequence consists of 80% LAS and the balance tungsten; and the last layer 167 consists essentially of LAS. The layer thickness scan be adjusted to lower increments to improve the FGM bond. A steel tube 170 may therefore be welded at 171 to layer 167, and used as a guide during launch, or to contain an explosive agent 172 for firing the projectile that comprises 162–167. Weld 171 may be a light, frangible weld, for example.

The process of the invention yields a fully dense microstructure and metallurgically sound bonds at 180–184, across the layered zones 162–167.

FIGS. 9–15 are magnified pictorial views of monolithic microstructures of listed metals, with FIGS. 9, 11, 12, 13, 14, and 15 showing interfacing between layers, as indicated.

I claim:

1. In the method of consolidating a body in any of initially powdered, sintered, fibrous, sponge, or other form capable of compaction, that includes the steps:

a) providing flowable pressure transmission particles having carbonaceous and ceramic composition or compositions, b) heating said particles to elevated temperature, c) locating said heated particles in a bed, d) positioning said body at said bed, to receive pressure transmission, e) effecting pressurization of said bed to cause pressure transmission via said particles to said body, thereby to compact and consolidate the body into desired shape, increasing its density; and f) the body to be consolidated having varying metallic composition along a body dimension.

2. The method of claim 1 wherein said varying metallic composition of the consolidated body is characterized by one of the following, along said dimension:

i) decreasing hardness ii) increasing toughness iii) decreasing hardness, and increasing toughness.

3. The method of claim 1 wherein said varying metallic composition is characterized by a series of zones, the metal of each zone having a characteristic composition which differs from that of an adjacent zone or zones.

4. The method of claim 3 wherein the metals in successive zones consist of metals from the group tungsten, iron, nickel, cobalt, manganese and titanium.

5. The method of claim 1 wherein said body consists of powders of metals selected from the group tungsten, nickel, iron, and cobalt that have been initially combined and compressed into body form, at pressure exceeding 20,000 pounds per square inch, prior to said step e) pressurization.

6. The method of claim 5 wherein at least part of said body has cylinder form.

7. The method of claim 5 including pre-heating said body to temperature in excess of 900° C., subsequent to said initial combining and compressing and prior to said pressurization.

8. The method of claim 5 including effecting said initial combining and compressing at ambient temperature.

9. The method of claim 5 including providing an elastomeric container, positioning said powders in said container, and effecting said initial compressing by compressing said container.

10. The method of claim 9 including evacuating gases from said container, prior to said initial compressing thereof.

11. The method of claim 10 including sealing of said container after evacuating gases therefrom.

12. The method of claim 11 wherein said initial compressing is effected to compress the body to about 60% of body theoretical density.

13. The method of claim 1 wherein said pressurization is effected to form the body into generally cylindrical shape.

14. The method of claim 1 including effecting said initial compressing to form the body into generally cylindrical shape, with taper at one end.

15. The method of claim 14 wherein said pressurization is carried out to reduce the body size while maintaining body generally cylindrical shape with taper at one end.

16. In the method of consolidating a body in any of initially powdered, sintered, fibrous, sponge, or other form capable of compaction, that includes the steps:

a) providing flowable pressure transmission particles having carbonaceous and ceramic composition or compositions, b) heating said particles to elevated temperature, c) locating said heated particles in a bed, d) positioning said body at said bed, to receive pressure transmission, e) effecting pressurization of said bed to cause pressure transmission via said particles to said body, thereby to compact and consolidate the body into desired shape, increasing its density, wherein the body to be consolidated has varying metallic composition along a body dimension, and wherein the powders at one zone of the body consist of tungsten particles coated with substances selected from the group that include nickel, iron, cobalt, manganese and titanium.

17. The method of claim 16 wherein the weight percent of nickel, iron, and cobalt is about 16% of the overall weight of the total powder.

18. The method of claim 1 wherein said particles are generally spheroidal and consist of graphite, and/or graphite and ceramic composite.

19. The method of claim 1 wherein said body in said bed, prior to said step e) is at a temperature between about 200° C. and 1,800° C.

20. The method of claim 1 wherein said body is positioned in said bed to be surrounded by said particulate, the bed consisting substantially entirely of particles in the form of graphite and/or graphite/ceramic beads.

21. The method of claim 15 wherein said bed contains sufficient of said flowable particles as to remain essentially free of agglomeration during said (e) step.

22. The method of claim 1 wherein said bed consists essentially of one of the following particulates:

i) graphite ii) ceramic iii) graphite and ceramic.

23. The method of claim 22 wherein the particle mesh size is between 50 and 240.

24. The method of consolidating metal powder to form an object, that includes:

a) pressing said powder into a preform, and preheating the preform to elevated temperature, b) providing flowable pressure transmitting particles and heating said particles, and providing a bed of said flowable and heated pressure transmitting particles, c) positioning the preform in such relation to the bed that the particles substantially encompass the preform, d) and pressurizing said bed to compress said particles and cause pressure transmission via the particles to the preform, thereby to consolidate the preform into a desired object shape, e) the preform consisting of W, Ni, Fe, and Co.

25. The method of consolidating metal powder to form an object, that includes:

a) pressing said powder into a preform, and preheating the preform to elevated temperature, b) providing flowable pressure transmitting particles and heating said particles, and providing a bed of said flowable and heated pressure transmitting particles, c) positioning the preform in such relation to the bed that the particles substantially encompass the preform, and wherein the powder at one zone of the body consists of tungsten particles coated with substances selected from the group that includes nickel, iron, cobalt, manganese and titanium.

26. The method of claim 25 wherein the weight percent of nickel, iron, and cobalt is about 16% of the overall weight of the total powder.

27. The method of claim 24 wherein said pressurization is effected at levels greater than about 20,000 psi for a time interval of less than about 30 seconds.

28. The method that includes a) providing particles to be used in pressure consolidation of a powdered preform, b) heating said particles, c) and pressurizing the heated particles to effect said consolidation, said particles consisting essentially of W, Ni, Fe, and Co.

29. The method of claim 28 wherein the Ni, Co and Fe constitute less than 50% of the overall weight of the particles.

30. The method of claim 28 wherein the initial powder consists of tungsten particles on which iron, nickel, and cobalt are coated.

* * * * *